United States Patent [19]

Takao et al.

[11] Patent Number: 4,549,512

[45] Date of Patent: Oct. 29, 1985

[54] INTAKE AIR AMOUNT CONTROL APPARATUS OF INTERNAL COMBUSTION ENGINE

[75] Inventors: Mitsunori Takao, Kariya; Takahiko Kimura, Nagoya; Yuzi Hirabayashi, Aichi, all of Japan

[73] Assignee: Nippondenso Company Ltd., Kariya, Japan

[21] Appl. No.: 650,212

[22] Filed: Sep. 13, 1984

[30] Foreign Application Priority Data

Sep. 21, 1983 [JP] Japan ..... 58-174712

[51] Int. Cl.[4] ..... F02D 33/02

[52] U.S. Cl. ..... 123/339; 123/350; 123/588

[58] Field of Search ..... 123/339, 340, 327, 350, 123/588, 585

[56] References Cited

U.S. PATENT DOCUMENTS

| | | | |
|---|---|---|---|
| 4,237,833 | 12/1980 | Des Lauriers | 123/320 |
| 4,306,527 | 12/1981 | Kinugawa et al. | 123/339 |
| 4,344,399 | 8/1982 | Matsumura et al. | 123/339 |
| 4,402,289 | 9/1983 | Ikeura | 123/339 |
| 4,467,761 | 8/1984 | Hasegawa | 123/339 |

*Primary Examiner*—Andrew M. Dolinar

*Attorney, Agent, or Firm*—Cushman, Darby & Cushman

[57] ABSTRACT

An intake air amount control apparatus of an internal combustion engine controls an air control valve provided at a by-path formed with respect to a throttle valve which is provided in an intake air path of the engine. When the open-loop control mode of the engine is set, the apparatus determines which of the feedback loop and the open-loop control mode has been performed. When it is found that the feedback loop control mode has been switched to the open-loop control mode, a control amount corresponding to a current cooling water temperature of the engine is read out from a preset map, thus preparing for the following open-loop control. Simultaneously, a control amount in the previous feedback control mode is read out, and a current open-loop control amount is calculated by adding a compensation value to the thus read-out control amount. When it is determined that the open-loop control mode is continuously performed, a control amount corresponding to the current cooling water temperature is read from the map. Then, the difference between this control amount and the prepared control amount is obtained. The current control amount is compensated for with reference to this difference, and the amount of intake air is controlled with reference to this control amount.

8 Claims, 8 Drawing Figures

INTAKE AIR AMOUNT CONTROL APPARATUS OF INTERNAL COMBUSTION ENGINE

BACKGROUND OF THE INVENTION

The present invention relates to an intake air amount control apparatus of an internal combustion engine which is mounted in, for example, a vehicle, and mainly concerns a control means for feeding back the engine speed to calculate a target engine speed. More particularly, the present invention relates to an improvement in an open-loop control mode of such a control means when the feedback loop control mode is switched to the open-loop control mode.

In internal combustion engines, in order to warm up the engines and to stabilize an idling speed, the idling speed is set to be high while the temperature of cooling water thereof is low. For this reason, when the temperature of the cooling water is low, that is, when warming-up of the engine has not been performed, the control amount of intake air to the engine must be large.

In such an engine idling state, the target engine speed corresponding to, for example, the temperature of cooling water is set and an actual engine speed is fed back to set this actual engine speed at the target engine speed. Techniques shown in U.S. Pat. No. 4,237,833, U.S. Pat. No. 4,306,527 and U.S. Pat. No. 4,344,399 are known as such an engine speed control means.

Except for the engine idling state in which the feedback-loop control mode is set, the open-loop control mode is set. When the valve opening position for controlling the amount of intake air in the open-loop control mode is set at a predetermined position, and when this open-loop control mode is switched to the feedback control mode, the valve opening cannot maintain the target engine speed in the corresponding feedback loop control mode. Therefore, in this feedback control mode, the actual engine speed becomes extremely high or extremely low.

In order to solve such a problem, the control amount "Dthw" of the intake air in the open-loop control mode is preset with respect to the engine speed, as shown in FIG. 1. Then, in the feedback loop control mode, the valve opening is controlled in accordance with this preset control amount value, as shown in FIG. 2.

However, in practice, the control device of an intake air amount of the actual internal combustion engine has flow characteristics that are different than the predetermined values which depend upon variations in the leak-flow amount when a throttle valve is fully closed and depend upon friction between the components thereof, resulting in a deterioration over time of its characteristics. Therefore, with respect to a plurality of engines or to a single engine, the control amount deviates from a predetermined value over time. For this reason, in the extreme case, as shown in FIG. 3, the control amount in the open-loop control mode becomes smaller than that corresponding to the target engine, thereby causing engine trouble such as stalling, especially when the vehicle's speed is decreased.

SUMMARY OF THE INVENTION

It is a main object of the present invention to provide, in an intake air amount control system for feeding back actual engine conditions to set the target idling speed of the engine, an intake air amount control apparatus of an internal combustion engine which can effectively control the amount of intake air when a feedback loop control mode is switched to an open-loop control mode.

It is another object of the present invention to provide a control apparatus which controls the amount of intake air when the feedback loop control mode is switched to the open-loop control mode to effectively stabilize the operation of the engine, and to smoothly control the engine speed.

It is still another object of the present invention to provide a control apparatus which when the feedback control mode is switched to the open-loop control mode, the open-loop control corresponds to a final control amount in the feedback control mode so that setting the control amount of intake air can be smoothly performed.

In an intake air amount control apparatus of an internal combustion engine according to the present invention, a feedback loop control mode or an open-loop control mode can be determined by a detection signal from an engine operating condition detecting means for detecting if a throttle valve is open, the engine speed, and vehicle speed. When the feedback loop control mode is determined, an intake air amount corresponding to the above-mentioned operation conditions of the engine is calculated, thereby setting the engine speed at a target engine speed. When the feedback control mode is switched to the open-loop control mode, the control amount in the open-loop control mode is calculated with reference to the intake air control amount and to the temperature of cooling water for the engine in the feedback loop control mode. Furthermore, when the open-loop control mode is continued, the control amount for the open-loop control corresponding to the temperature of the cooling water for the engine is set, thereby controlling the amount of intake air with respect to the engine.

Therefore, in the intake air amount control apparatus of the internal combustion engine having such a construction and, more particularly, when the feedback loop control mode is switched to the open-loop control mode, the intake air amount for the internal combustion engine can be effectively controlled and the engine speed can be stabilized with correspondence to, for example, the warming-up of the engine. In an engine control apparatus including a means for feeding back actual engine conditions to set an engine speed at a target engine speed, not only in the feedback control mode but also in the state wherein the feedback control mode is switched to the open-loop control mode, the amount of intake air can be controlled, so that the engine's speed can be stably controlled.

DETAILED DESCRIPTION OF THE PREFERRED EMBODIMENT

Figure 4:
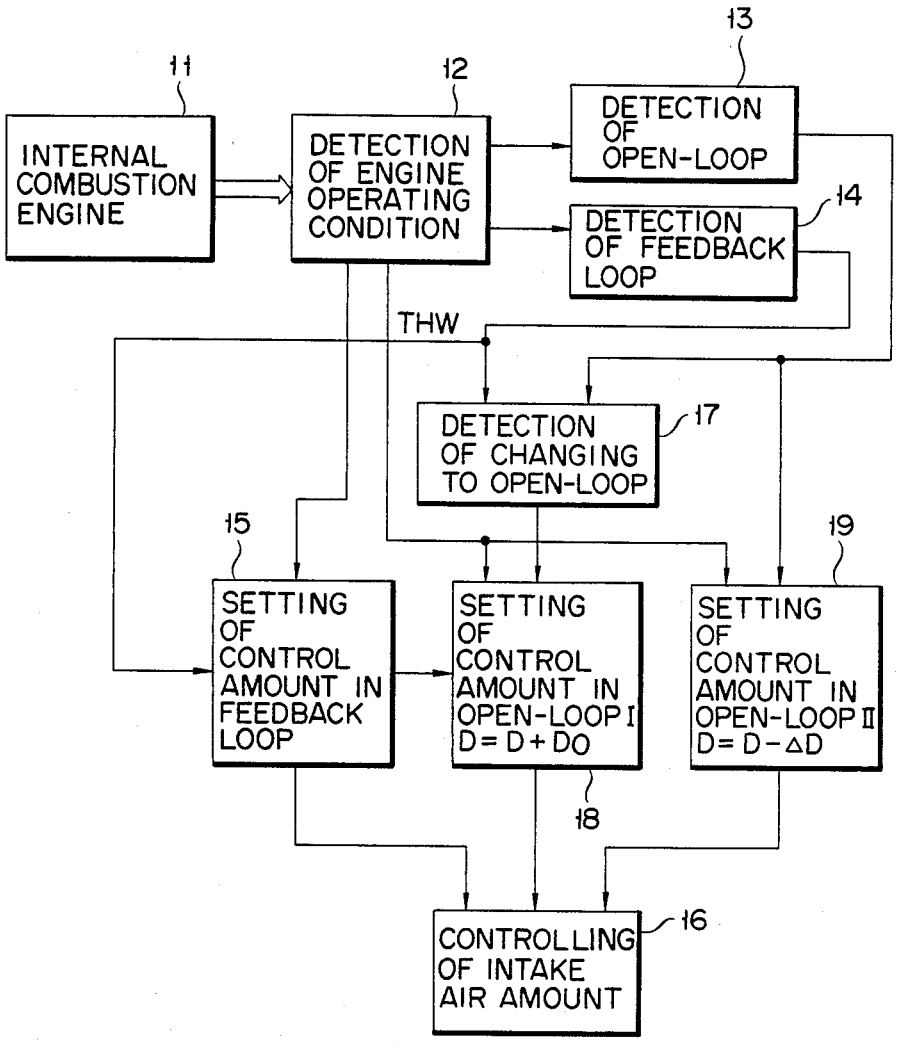
FIG. 4 is a schematic circuit diagram for explaining an intake air amount control apparatus of an internal combustion engine according to an embodiment of the present invention.

FIG. 4 schematically shows a control apparatus for controlling and setting the amount of intake air of an internal combustion engine. In the control apparatus, an engine operating condition detector 12 detects the operating condition of an internal combustion engine 11. More specifically, it detects if the throttle is open, the speed of the engine 11, the speed of a vehicle in which this engine 11 is mounted, and the like. An engine operating condition detection signal detected by this detector 12 is supplied to an open-loop detector 13 and to a feedback loop detector 14. When the open-loop detector 13 detects that the engine 11 is not in the engine idling mode in accordance with the engine operating condition detection signal, the detector 13 generates an open-loop detection signal. When the feedback loop detector 14 detects that the engine 11 is in the engine idling mode in accordance with the engine operating condition detection signal, it generates a feedback loop detection signal.

In other words, when the engine 11 is in the feedback control mode, the feedback loop detector 14 generates an output signal to a feedback loop control amount setting device 15. The feedback loop control amount setting device 15 calculates the amount of intake air corresponding to the operating conditions of the engine 11 in response to this output signal. Then, the setting device 15 provides a control instruction corresponding to the above control amount to an intake air amount control device 16, thus performing control of the intake air amount under feedback loop control.

On the other hand, when the control mode of the engine 11 is switched from the feedback loop control mode to the open-loop control mode, this switched mode is detected by a change detector 17. A change detection signal from the change detector 17 is supplied as an instruction signal to a first open-loop control amount setting device 18. The first open-loop control amount setting device 18 calculates the intake air amount at this time from the control amount in the feedback loop control mode and the cooling water temperature THW of the engine 11, thereby controlling the intake air amount control device 16.

When the engine 11 remains in the open-loop control mode, the output signal from the open-loop detector 13 is supplied as an instruction signal to a second open-loop control amount setting device 19. The second open-loop control amount setting device 19 sets an open-loop control amount corresponding to the cooling water temperature THW, thereby controlling the amount of intake air.

Figure 5:
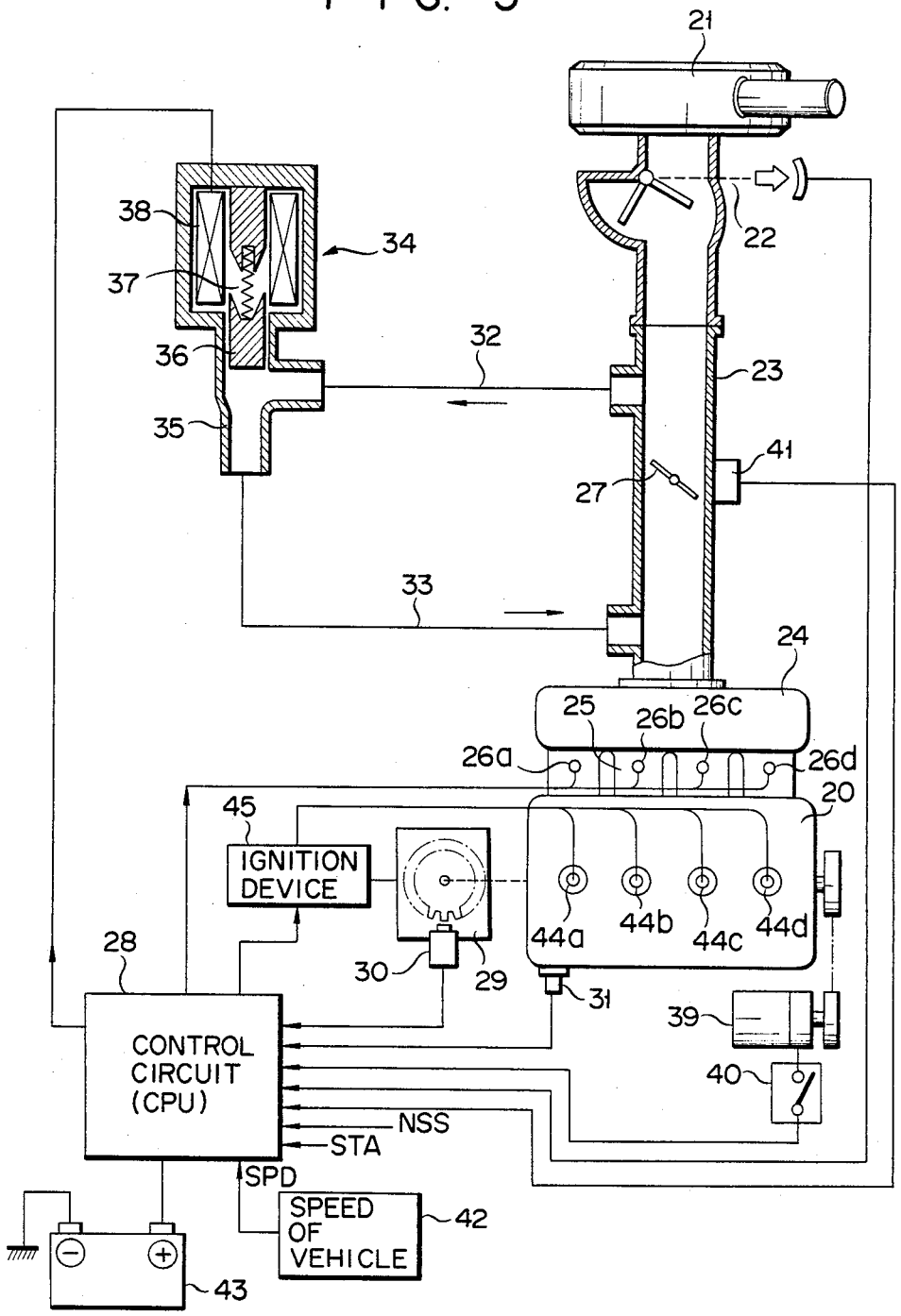
FIG. 5 is a circuit diagram for explaining the control apparatus shown in FIG. 4 with reference to the relationship between it and the internal combustion engine.

FIG. 5 shows the construction of the apparatus shown in FIG. 4. An engine 20 which is mounted in a vehicle is an internal combustion engine of a 4-cycle ignition type. An air conditioner for a vehicle and an automatic transmission system for transmitting power to an axle (neither is shown) are mounted as a load for the engine 20.

Air is supplied to the engine 20 through an air cleaner 21, an airflow meter 22, an air intake pipe 23, a surge tank 24 and intake branch pipes 25. Fuel is injected from electromagnetic fuel injection valves **26*a* to 26*d* provided with the respective intake branch pipes 25**.

In this case, a principal intake amount with respect to the engine 20 is controlled by a throttle valve 27, and a fuel injection amount is controlled by a control circuit 28 including a microcomputer. The known control circuit 28 calculates the fuel injection quantity using as reference parameters a signal corresponding to an engine speed detected by an engine speed sensor 30 comprising an electromagnetic pick-up provided in a distributor 29 of the engine 20 and by an intake air amount signal measured by the airflow meter 22. A signal from an engine warming-up sensor 31 is supplied to the control circuit 28.

In the intake air pipe 23, air pipes 32 and 33 are provided at upper and lower sides of the throttle valve 27. The air pipes 32 and 33 are respectively coupled to an air control valve 34, thereby forming by-paths to the throttle valve 27.

The air control valve 34 mainly consists of a valve mechanism driven by a linear solenoid. In the air control valve 34, the air path area between the air pipes 32 and 33 can be variably controlled by the position of a plunger 36 which is movable in a housing 35.

The plunger 36 is set to achieve an air path area by a compression force of a compression coil spring 37. When an exciting current is applied to an exciting coil 38, the plunger 36 is driven against the compression force of the spring 37, thereby controlling the opening of the air path. In this case, when the exciting current for the exciting coil 38 is continuously and variably controlled, a by-path airflow amount with respect to the throttle valve 27 can be sequentially and variably controlled.

In this case, the exciting current for the exciting coil 38 is set to be a current having a pulse-like waveform whose pulse width can be controlled. When this pulse width of the exciting current is controlled, the exciting current value can be digitally controlled.

The air control valve 34 is controlled by the control circuit 28 in the same manner as the fuel injection valves **26*a* to 26*d*. It should be noted that a diaphragm type control valve or a step motor controlled valve can be used instead of the control valve 34** having the above-mentioned construction.

A signal from an air-conditioner switch 40 of an air conditioner 39, a signal from a throttle opening sensor 41, and a vehicle speed signal SPD from a vehicle speed sensor 42 are supplied to the control circuit 28 as are the detection signals from the engine speed sensor 30 and the engine warming-up sensor 31. A starter signal STA and a neutral safety signal NSS from the automatic transmission system are also coupled to the control circuit 28. Furthermore, a voltage signal from a battery 43 is also supplied to the control circuit 28.

The engine speed sensor 30 is opposite a ring gear which rotates upon rotation of a crank shaft of the engine 20 and generates a pulse signal having a frequency proportional to the engine speed of the engine 20. The engine warming-up sensor 31 comprises a temperature detector such as a thermistor, and detects the cooling water temperature of the engine 20. The distributor 29 supplies ignition signals of high voltages to spark plugs 44*a* to 44*d* of the respective cylinders of the engine 20. In this case, the ignition device 45 consists of an ignitor and an ignition coil.

Figure 6:
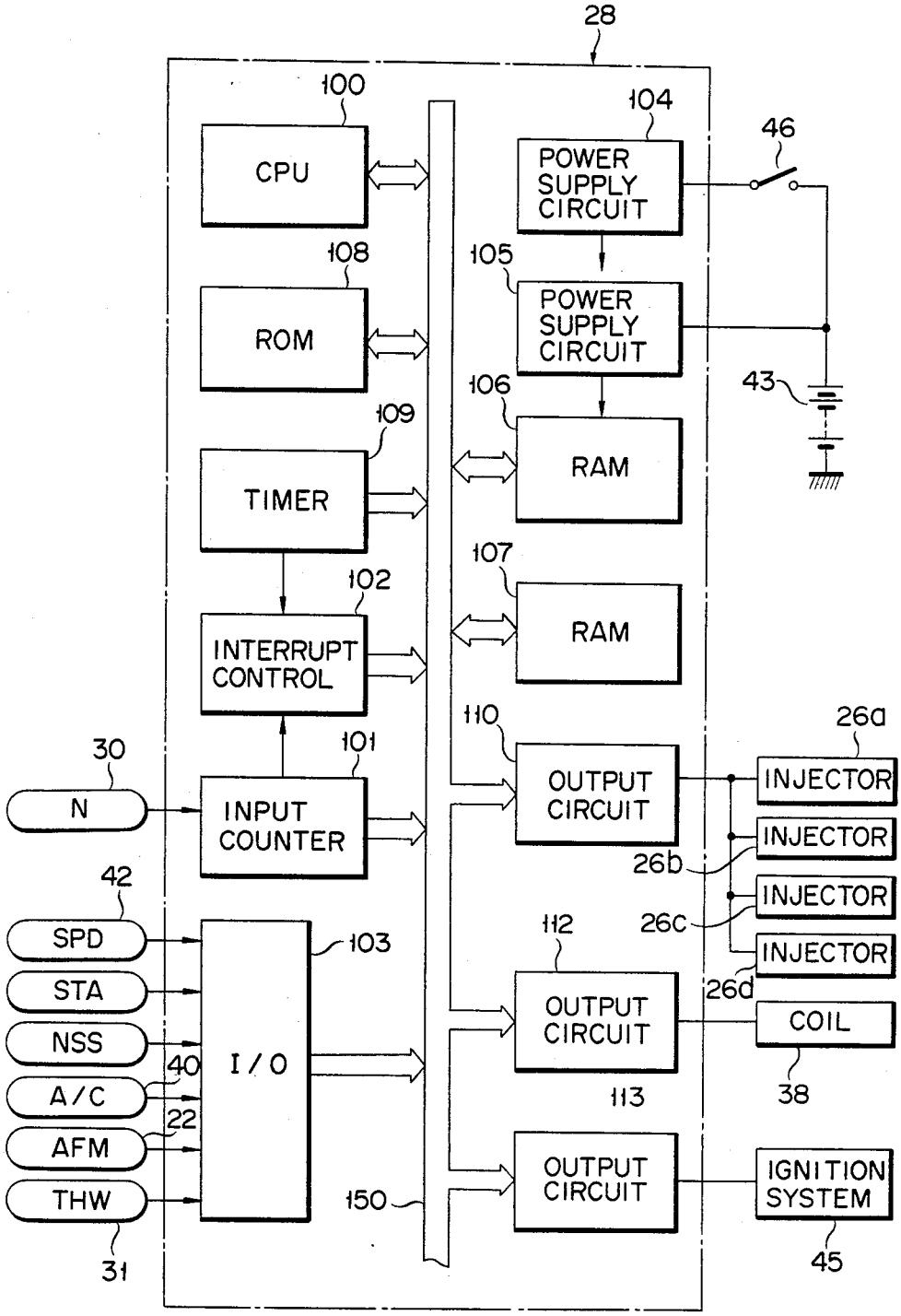
FIG. 6 is a circuit diagram for explaining a control circuit used in the embodiment.

FIG. 6 shows a configuration of the control circuit 28. A microprocessor (CPU) 100 calculates ignition timing, the fuel injection quantity and the intake air amount in the feedback loop control mode during engine idling in accordance with a predetermined program.

An input counter 101 supplies an engine speed signal N from the engine speed sensor 30 to the CPU 100 through a bus 150. The counter 101 supplies an interruption instruction signal to an interruption control 102 in synchronism with the revolution of the engine 20. The interruption control 102 supplies an interruption signal to the CPU 100 through the bus 150 in response to the interruption instruction signal.

An input port 103 supplies detection signals from respective sensors to the CPU 100 through the bus 150. The input port 103 includes an A/D converter, multiplexer, and the like and receives an intake air amount signal AMF from the airflow meter 22; an air-conditioner signal A/C from the air-conditioner switch 40; the neutral safety signal NSS; the vehicle speed signal SPD from the vehicle speed sensor 42; the starter signal STA from an engine start switch; and the like.

The output voltage from the battery 43 is stabilized by power supply circuits 104 and 105. The power supply circuit 104 is coupled to the battery 43 through an engine key switch 46. The power supply circuit 105 is directly coupled to the battery 43 and always supplies power to a RAM 106. Therefore, when the engine 20 is stopped, power can still be supplied to the RAM 106, thereby preventing undesirable erasure of the memory contents of the RAM 106.

The RAM 106 and a RAM 107 are temporarily used by the CPU 100 when the CPU 100 executes a program. More particularly, as power is always supplied to the RAM 106 in the above manner it configurates a power supply back-up type memory.

A ROM 108 stores program data and various constants. The CPU 100 reads out the program data and the like from the ROM 108 through the bus 150. In addition, a timer 109 generates a clock pulse so as to measure a time sequence, and supplies a clock signal to the CPU 100 and generates a time interruption signal with respect to the interruption control 102.

An output circuit 110 generates a driving signal which has a pulse-like waveform having a time width corresponding to data representing the fuel injection quantity. The output circuit 110 generates this pulse signal to the respective injection valves 26*a* to 26*d*, thus controlling the time interval needed to perform fuel injection, that is, the fuel injection quantity.

An output circuit 112 generates a pulse signal having a duty ratio corresponding to data representing the control amount of the intake air in the engine idling mode calculated by the CPU 100 and also represents this control amount. This pulse signal controls the exciting current of the exciting coil 38 of the air control valve 34. An output circuit 113 generates an ignition timing signal corresponding to the control amount of intake air with reference to the ignition timing data calculated by the CPU 100. Then, the output circuit 113 supplies this signal to an ignitor unit of the ignition device 45.

Figure 7:
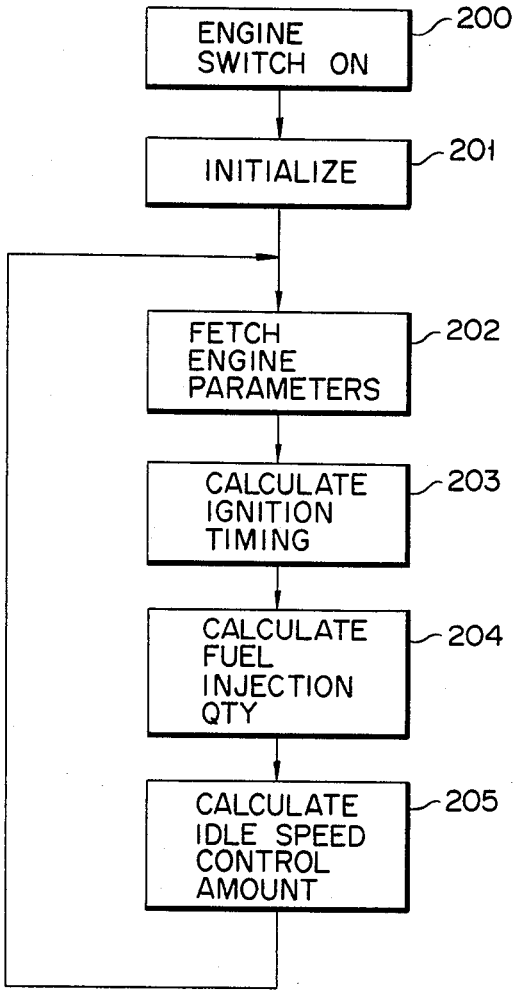
FIG. 7 is a flow chart for explaining a main routine of the control circuit shown in FIG. 6.

In the control circuit 28 having the configuration as described above, a microprocessor which can perform a high-speed operation is used as the CPU 100. The CPU 100 calculates ignition timing, fuel injection quantity, the control amount of the intake air, and the like by the main routine shown in FIG. 7 with reference to the program stored in the ROM 108.

When an engine switch is turned on in step 200, the CPU 100 is initialized in step 201. In step 202, a fetch routine of engine parameters is set, and various parameters used in the calculation necessary for engine control are fetched. When such parameters have been fetched, calculations for the ignition timing, the fuel injection quantity, the idle speed control amount, and the like are performed in steps 203, 204 and 205.

Figure 8:
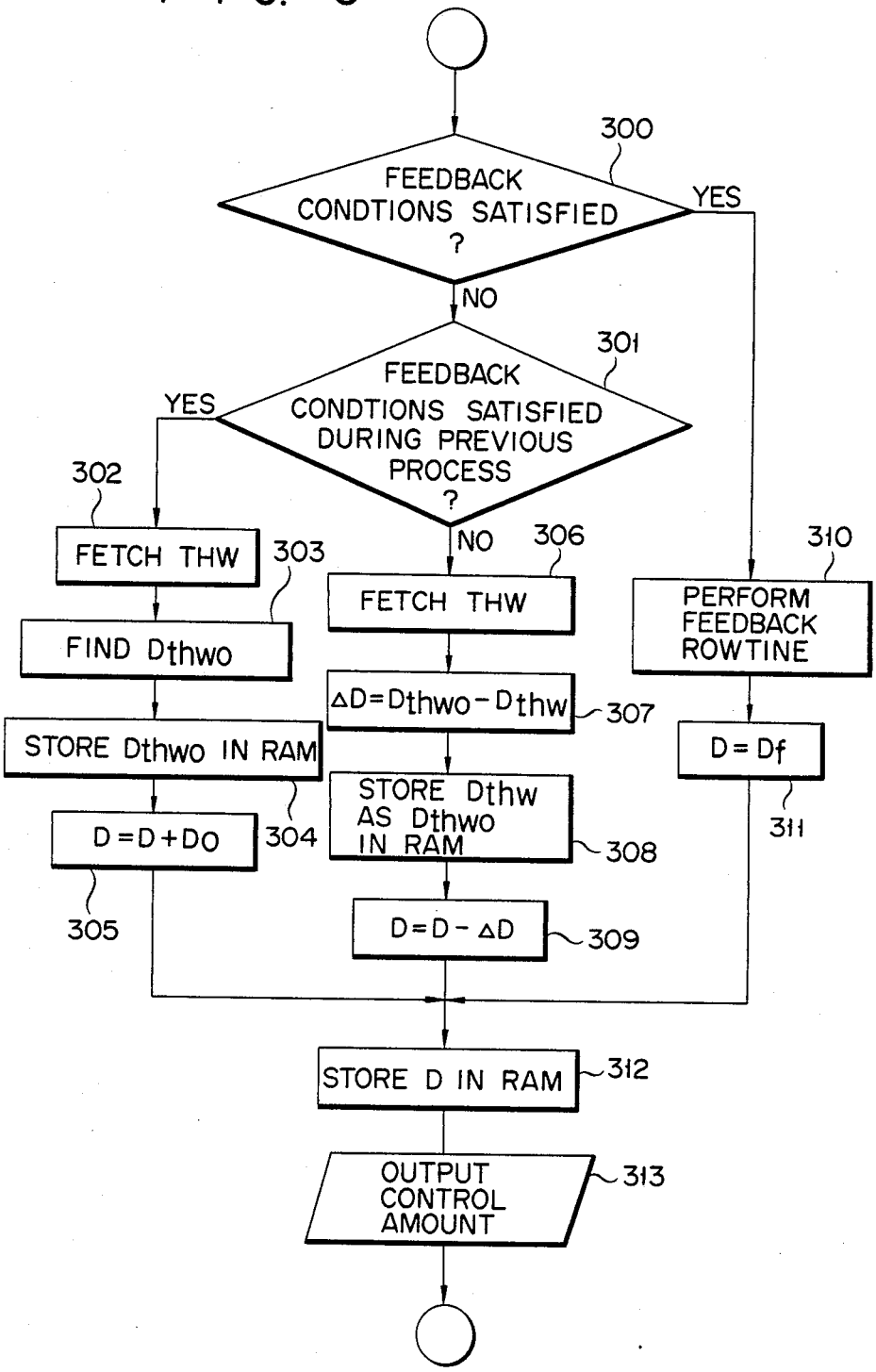
FIG. 8 is a flow chart showing flow of a main part of the main routine shown in FIG. 7 in more detail.

FIG. 8 shows a flow chart explaining the operation of the control circuit 28. This flow is included in the idle speed control amount calculation routine 205 of FIG. 7.

In step 300, the CPU 100 determines whether or not the current vehicle condition satisfies the conditions for executing the feedback loop control mode. The conditions for executing the feedback loop control mode are satisfied when the open throttle, the engine speed, and the vehicle speed are all below their respective predetermined values. When the above conditions are not satisfied, the flow advances to step 301 for executing the open-loop control mode.

Figure 1:
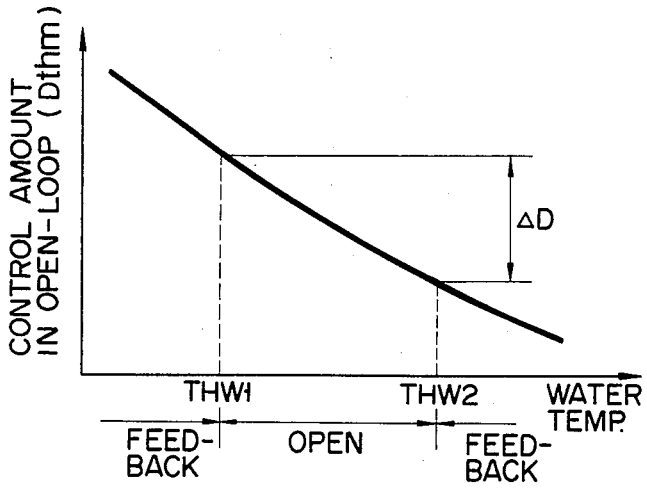
FIG. 1 is a graph showing the relationship between the temperature of cooling water and the control amount of intake air in the open-loop control mode in an internal combustion engine.
Figure 2:
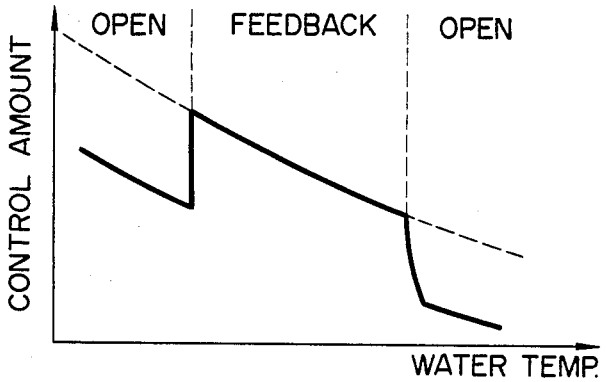
FIGS. 2 and 3 are respectively graphs for explaining examples of controlling conditions of the open-loop control mode and the feedback control mode which are respectively set with reference to the control amount shown in FIG. 1.
Figure 3:
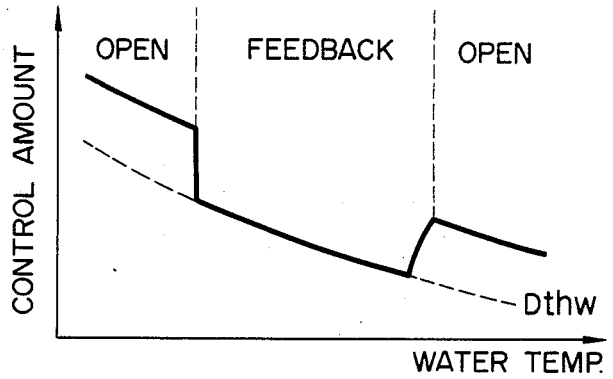

In step 301, the CPU 100 determines whether or not the conditions for the feedback loop control mode were satisfied during the previous process. When the conditions were satisfied during the previous process, the flow advances to step 302 to obtain the initial value of an open-loop control amount. In step 302, cooling water temperature data THW is fetched and control amount data Dthw corresponding to the data THW is obtained in step 303. The control amount data Dthw is mapped as shown in FIG. 1, is stored in the ROM 108, and is read out from the map stored in the ROM 108 with reference to the cooling water temperature data THW. The control amount data Dthw is stored at a predetermined address of the RAM in step 304, thus preparing for the following open-loop control mode.

In step 305, an initial value D for the open-loop control amount is obtained from D+D0. Note that "D" here means the feedback control amount in the previous process and that "D0" is a constant. The output value D thus obtained in step 305 is stored as control amount data Dthwo at a predetemined address in the RAM in step 312. In step 313, the output value D of the control amount is supplied to the output circuit 112 as an intake air control instruction, and this calculation routine ends.

When the CPU determines in step 301 that the previous process is also in the open-loop control mode, the flow advances to step 306. In step 306, the cooling water temperature data THW is fetched, and the control amount data Dthw corresponding to the current cooling water temperature is found from the map of the ROM 108. Then, the data Dthw is subtracted from the data Dthwo obtained in step 303, thereby obtaining the difference ΔD therebetween in step 307.

In step 308, the thus obtained data Dthw is stored as the data Dthwo in the RAM, thereby preparing the calculation for obtaining the difference ΔD. In step 309, D=D−ΔD is calculated and a final output value is obtained. Then, the following processes in step 312 and 313 are performed and this routine ends.

When the vehicle conditions satisfy the conditions for the feedback loop control mode in step 300, the flow advances to step 310, and the feedback routine is executed. It should be noted that the feedback routine is not so important in the present invention and so a detailed description therefor is omitted.

In step 311, the calculated value data Df is fetched as the output value D. The following processes are performed and this routine ends.

What is claimed is:

1. An intake air amount control apparatus of an internal combustion engine, comprising:

control mode detection means for detecting one of an open-loop control mode and a feedback loop control mode from operating conditions of the engine;

feedback control amount calculation means for calculating a feedback control amount in accordance with a detection output corresponding to said operating conditions when said control mode detection means detects said feedback loop control mode;

change detection means for detecting a change from said feedback loop control mode to said open-loop control mode;

first control amount calculation means for obtaining a first control amount corresponding to conditions of the engine during warming-up and storing the first control amount when a change detection signal from said change detection means is generated, and for calculating an open-loop control amount with reference to said feedback control amount;

second control amount calculation means for obtaining second control amount corresponding to said conditions of the engine during warming-up storing the second control amount for as long as said open-loop control mode is continued, and for calculating another open-loop control amount corresponding to a difference between said first control amount and said second control amount; and engine control means for controlling an intake air amount in accordance with said open-loop control amounts obtained by said first and second control amount calculation means, thereby controlling an engine speed in said open-loop control mode.

2. An apparatus according to claim 1, wherein said control mode detection means comprises engine speed detection means and throttle opening detection means, and detects said feedback loop control mode when detection values from said engine speed detection means and said throttle opening detection means fall below corresponding predetermined values.

3. An apparatus according to claim 1, wherein said feedback control amount calculation means comprises a memory device for storing a calculated feedback control amount, said calculated feedback control amount being sequentially updated and being stored in said memory device.

4. An apparatus according to claim 1, wherein said first and second control amount calculation means comprise third control amount calculation means for obtaining a third control amount corresponding to a temperature of the engine, said third control amount calculation means comprising another memory device for storing a map which represents the relationship between a cooling water temperature of the engine and said third control amount.

5. An apparatus according to claim 1, wherein said first control amount calculation means comprises detection means for detecting the cooling water temperature of the engine, means for obtaining a third control amount corresponding to the cooling water temperature of the engine, storing means for storing said third control amount obtained by said means as a reference control amount for a next open-loop control mode, read-out means for reading out and detecting a final control amount in said feedback loop control mode, and calculation means for calculating a current open-loop control amount by adding a compensation value to said final control amount.

6. An apparatus according to claim 1, wherein said second control amount calculation means comprises means for obtaining a third control amount corresponding to the current cooling water temperature of the engine, means for obtaining a difference control amount between said third control amount and a previous open-loop control amount, means for storing said third control amount for a next calculation process, and means for calculating a current control amount by subtracting said difference control amount from said previous open-loop control amount.

7. An apparatus according to claim 1, wherein said engine control means comprises an air control valve which is set to constitute a by-path of a throttle valve portion provided in an intake air path with respect to the engine, an opening of said air control valve being controlled by said open-loop control amount.

8. An apparatus according to claim 7, wherein said air control valve comprises a plunger which is provided to close said by-path, and an exciting coil for driving said plunger in a direction to open said by-path in correspondence to an exciting current, said exciting coil being controlled by a current signal corresponding to said open-loop control amount.

* * * * *